United States Patent [19]

Frenchik

[11] Patent Number: 4,535,056

[45] Date of Patent: Aug. 13, 1985

[54] YELLOW COLOR FORMERS FOR USE IN COLOR PHOTOTHERMOGRAPHIC SYSTEM

[75] Inventor: Robert A. Frenchik, Somerset Township, St. Croix County, Wis.

[73] Assignee: Minnesota Mining and Manufacturing Company, St. Paul, Minn.

[21] Appl. No.: 590,485

[22] Filed: Mar. 15, 1984

[51] Int. Cl.[3] ..... G03C 1/02

[52] U.S. Cl. ..... 430/542; 430/619; 430/620; 430/570; 430/351; 430/353

[58] Field of Search ..... 430/619, 620, 523, 338, 430/353, 542, 351, 570

[56] References Cited

U.S. PATENT DOCUMENTS

| | | | |
|---|---|---|---|
| 3,985,565 | 10/1976 | Gabrielsen et al. | 96/114.1 |
| 4,021,240 | 5/1977 | Cerquone | 96/29 |
| 4,021,250 | 5/1977 | Sashihara et al. | 96/114.1 |
| 4,260,677 | 4/1981 | Winslow et al. | 430/618 |
| 4,374,921 | 2/1983 | Frenchik | 430/559 |
| 4,452,883 | 6/1984 | Frenchik et al. | 430/502 |
| 4,460,681 | 7/1984 | Frenchik | 430/502 |
| 4,531,286 | 9/1970 | Renfrew et al. | 96/67 |

FOREIGN PATENT DOCUMENTS 2075496 11/1981 United Kingdom .

OTHER PUBLICATIONS

Research Disclosure No. 17029, J. W. Carpenter and P. W. Lauf.

Research Disclosure No. 17706.

*Primary Examiner*—Won H. Louie

*Attorney, Agent, or Firm*—Donald M. Sell; James A. Smith; Lorraine R. Sherman

[57] ABSTRACT

A photographic construction comprises at least one spectrally-sensitized polymeric binder layer containing photographic silver halide and, in association therewith a. a non-light sensitive organic silver salt oxidizing agent, b. at least one biphenol color-forming reducing agent having the formula

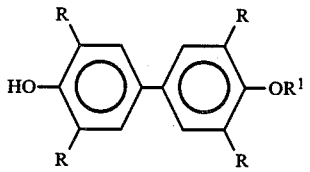

wherein each R is independently selected from a straight chain or branched alkyl or alkoxy group having 1 to 6 carbon atoms, and phenyl, and $R^1$ is hydrogen or an alkalilabile protecting group, and c. at least one aliphatic or aromatic carboxylic acid of a specific class, which preferably is p-aminobenzoic acid, as development modifier, and d. optionally, at least one toner.

16 Claims, No Drawings

YELLOW COLOR FORMERS FOR USE IN COLOR PHOTOTHERMOGRAPHIC SYSTEM

FIELD OF THE INVENTION

This invention relates to silver halide photographic color constructions and in particular to yellow color formation in photothermographic constructions. These constructions are useful in combination with cyan and/or magenta color formers in a two or three color separation photothermographic recording system.

BACKGROUND ART

Silver halide photothermographic imaging materials, often referred to as 'dry silver' compositions because no liquid development is necessary to produce the final image, have been known in the art for many years. These imaging materials basically comprise a light-insensitive, reducible silver source, a light-sensitive mateial which generates silver when irradiated, and a reducing agent for silver ion in the silver source. The light-sensitive material is generally photographic silver halide which must be in catalytic proximity to the light-insensitive silver source. Catalytic proximity is an intimate physical association of these two materials which enables catalysis of the reduction of the silver source by silver specks formed on the silver halide. Exposure of the silver halide to light produces small clusters of silver atoms. The imagewise distribution of these clusters is known in the art as the latent image. This latent image generally is not visible by ordinary means and the light-sensitive article must be further processed in order to produce a visual image. The visual image is produced by the catalytic reduction of silver ions which, as already noted, are in catalytic proximity to the specks of the latent image.

The silver source used in this area of technology is a material which contains a reducible source of silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and U.S. Pat. No. 4,260,677 discloses the use of complexes of inorganic or organic silver salts as image source materials.

Color-forming, 'dry silver' imaging systems are known in the photographic art. Color-formation is based on the oxidation/reduction reaction between the light-exposed silver salt of a fatty acid which has been halidized and dye-sensitized to a specific wavelength and is used with a chromogenic developer in the presence of elevated temperature. For example, U.S. Pat. No. 3,531,286 teaches the inclusion of color coupler components such as a p-phenylenediamine developer and a phenolic or active methylene coupler in close proximity to the light-sensitive emulsion, J. W. Carpenter and P. W. Lauf, Research Disclosure No. 17029, issued June 1978, review prior art relating to photothermographic silver halide systems which include color formation.

U.S. Pat. No. 4,021,240 discloses the use of sulfonamidophenol reducing agents and four equivalent photographic color couplers in thermographic and photothermographic emulsions to produce dye images including multicolor images.

U.S. Pat. No. 3,985,565 discloses the use of a certain class of phenolic type photographic color couplers in photothermographic emulsions to provide a color image.

U.S. Pat. No. 3,531,286 discloses the use of photographic phenolic or active methylene color couplers in photothermographic emulsions containing p-phenylenediamine developing agents to produce dye images.

Research disclosure 177006, published January 1979, discloses a photothermographic material containing an azo dye reducing compound, 2,2',6,6'-tetrachlorobiphenol as an auxiliary developing agent, in combination with a development modifier such as N-hydroxynaphthalimide.

U.S. Pat. No. 4,021,250 discloses thermally developable photosensitive material comprising certain dihydroxybiphenyls as reducing agent in the presence of certain polyarylamino compounds. No color-forming properties are recognized.

G.B. Pat. No. 2,075,496 discloses a wet process for producing black and white or color photographic images. Certain bisphenols are stated to be useful as dye-forming developing agents.

SUMMARY OF THE INVENTION

The present invention comprises at least one and preferably at least two color-forming layers, one of which provides a yellow color, each having a color-former reducing agent which can be a phenolic material or a leuco dye, a silver source, and silver halide therein. For example, the yellow monocolor system can be blue-sensitized. Its silver or topcoat layer, which contains as the silver reducing agent a biphenol electron-donating derivative whose oxidative product is yellow, also contains a carboxylic acid from a specific class as development modifier and, optionally, a toner. When two or more color-forming layers are present, barrier polymers are useful.

Preferably, photothermographic color constructions of the present invention incorporate at least two spectrally-sensitized color-forming layers to produce a multi-color photothermographic color recording system. The spectral sensitization may be to a pair of colors, one of which is blue, and the other can be any color such as orange, yellow, red, green, or purple provided that each color-forming layer is sensitized to a portion of the spectrum at least 60 nm different from the other color-forming layer, and each color-forming layer contains a color-former of a leuco dye which when oxidized forms a visible color having a maximum absorbance at least 60 nm different from that of the color formed in the other color-forming layer. Preferably, the absorbance maximum of colors formed will differ at least 80 or 100 nm. When three colors are to be formed, two should differ by at least these minimums, and the third should differ from at least one of the other dyes by at least 150 nm and preferably at least 200 or even at least 250 nm. This will provide a good, full color range for the final image. Preferred combinations of colors to which the construction may be sensitized are yellow-cyan, yellow-magenta, and yellow-cyan-magenta. A barrier polymer which is impervious to the solvent system of a color construction above it is coated between each pair of color-forming layers. Such a barrier polymer or barrier polymers are essential for the production of good color separation. This type of construction with the proper solvent selection is conducive to the use of simultaneous multiple coating techniques with good color separation.

It is known in the art that certain phenolic leuco dyes form color when reacted with a silver salt in the presence of a development modifier. It is not known that biphenols, in the presence of a specific class of acid development modifiers, are oxidized to form yellow to gold colors and are useful in color separation photothermographic systems.

In the present invention:

"aryl" means phenyl and naphthyl;

"arylene" means phenylene and naphthylene; and

"in association with" means in the same layer or in a layer contiguous thereto. For example, the location of the photosensitive silver halide in the photothermographic element or composition of the invention is such that will enable catalytic action. The described photosensitive silver halide can accordingly be in the same layer as or in a layer contiguous to the described oxidation-reduction image-forming combination (i.e., the silver salt oxidizing agent such as silver behenate or silver stearate and the reducing agent and development modifier of the present invention).

DETAILED DESCRIPTION

The present invention provides a photothermographic construction, preferably of the 'dry silver' type, comprising at least one spectrally-sensitized polymeric binder layer containing photographic silver halide and, in association therewith a. a non light-sensitive organic silver salt oxidizing agent, b. at least one biphenol color-forming reducing agent having the formula

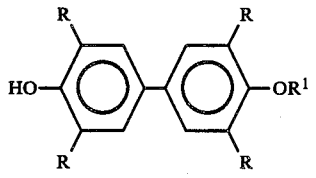

I wherein each R is independently selected from a straight chain or branched alkyl or alkoxy group having 1 to 6 carbon atoms, and phenyl, and $R^1$ is hydrogen or an alkalilabile protecting group (i.e., a group which is converted to or replaced by hydrogen at a pH greater than 7.0), e.g. acetyl, chloroacetyl, dichloroacetyl, trichloroacetyl, trifluoroacetyl, carboalkyl, carboaryloxy, carbonate, benzoyl, n-nitrobenzoyl, 3,5-dinitrobenzoyl and 2-benzenesulphonyl-1-ethoxycarbonyl, and c. at least one aliphatic or aromatic carboxylic acid as development modifier, the acid having the formula $$R(COOH)_x$$

wherein x is an integer having the value 1 or 2,

R is a group which is unsubstituted or substituted by at least one group selected from amino, hydroxyl, lower alkyl ($C_1$ to $C_4$), nitro, and one or two chloro atoms, wherein when x is 1, R is selected from the group consisting of alkenyl, aryl, and phenylalkyl, having up to 10 carbon atoms, and when x is 2, R is selected from the group consisting of alkenylene, alkylene, and arylene, having up to 14 carbon atoms; and d. optionally, at least one toner selected from phthalazinone, imidazole, phthalimide, N-aminophthalimide, and preferably phthalazine.

It is known in the art of photography (see G.B. Pat. No. 2,075,496 which relates to alkaline wet processing systems) that certain biphenols are useful as color-formers in conjunction with a monoamino carboxylic acid as development stabilizer. In aqueous systems, the development process allows the silver to be washed away so that the resulting image can be a clear (non-darkened) color. However, in photothermographic systems (photosensitive, heat-developable, dry processible systems) the darkening effect of silver cannot be eliminated by washing the silver away. Common developing agents such as phthalazinone or a combination of phthalic acid and phthalazine produce a green-yellow or brown-yellow image. Surprisingly, certain carboxylic acids, preferably p-aminobenzoic acid, as development modifier, optionally in the presence of a toner, surpress the formation of a dark silver image and provide a yellow color. Other carboxylic acids, e.g., phthalic acid, benzoic acid, maleic acid, dichloromaleic acid, succinic acid, suberic acid, cinnamic acid, nitrocinnamic acid, 3- or 4-methylphthalic acid, 3- or 4-nitrophthalic acid, 4-aminosalicylic, 3,5-diaminobenzoic, and 2,3-naphthalenedicarboxylic acid also provide a yellow color but at a reduced reaction rate. Sulfonic or halogenated acids such as benzene sulfonic acid, p-toluene sulfonic acid, tetrabromophthalic acid and tetrabromophthalic acid anhydride are not at all useful in the present invention.

Further, it has been found that in the presence of certain polymers in the sensitized layer, certain biphenols can be used as the yellow color-former using p-aminobenzoic acid optionally in combination with other carboxylic acids such as phthalic acid or 4-nitrophthalic acid as the development modifier with no toner present. For example, useful polymers include 25 weight percent of the monoethyl ester of poly(methyl vinyl ether/maleic acid) (25 weightpercent ethanol-50 weight percent ethanol) (Gantrez -ES 225, GAF Corp.); 10 weight percent of cellulose acetate/(90 weight percent acetone); or 10 weight percent of Gantrez -ES 225/polyvinylpyrrolidone complex/(6.25 weight percent ethanol-83.75 weight percent methanol); 5 weight percent of polyvinyl butyral resin, m.w. 180,000 to 270,000 (Butvar TM -B 76, Monsanto Corp.)/95 weight percent toluene; 10 weight percent neutralized Gantrez -ES 225/(10 weight percent ethanol-80 weight percent methanol); 10 weight percent polyvinylpyrrolidone/90 weight percent methanol; 10 weight percent polyvinylpyrrolidone 25 weight percent neutralized Gantrez -ES 225/(25 weight percent ethanol-50 weight percent methanol); 10 weight percent polyvinyl butyral (Butvar -B 76)/90 weight percent ethanol; 10 weight percent cellulose acetate butyrate (Eastman alcohol soluble) in 45 weight percent ethanol-45 weight percent methanol; and 20 weight percent methyl methacrylate copolymer (Acryloid TM -A21, Union Carbide in 43.2 weight percent toluene-33.2 weight percent ethanol-4.8 weight percent butanol. In association with a substituted biphenol as reducing agent and p-aminobenzoic acid as development modifier, there is provided a useful yellow color in a photothermographic system after exposure and development.

A clear yellow color is the preferred color formed by the substituted biphenols of the invention. However, gold colors are also useful.

The leuco dyes and phenolic color-formers used in the present invention may be any colorless or lightly colored compound which forms a visible color upon oxidation, preferably in the presence of a carboxylic acid. The compound must be oxidizable to a colored state. Compounds which are both pH sensitive and oxidizable to a colored state are useful but not preferred, while compounds only sensitive to changes in pH are not included within the term "leuco dyes" since they are not oxidizable to a colored form.

Any substituted biphenol yellow color-former of formula I and optionally a different color-forming phenol material or a leuco dye capable of being oxidized by a silver ion in the presence of a carboxylic acid to form a visible image is useful in the present invention as previously noted. Color-forming phenolic materials and leuco dyes are those known in the art such as those disclosed in U.S. Pat. No. 4,374,921, which disclosure of color-formers and leuco dyes is incorporated herein by reference. Preferred dyes are described in the above-mentioned patent application, U.S. Ser. No. 475,441, which is incorporated herein by reference.

Examples of biphenol color-forming reducing agents of the present invention include:

| Structure | Name |
|---|---|
| 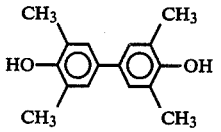 | 2,2',6,6'-tetramethyl-4,4'-biphenol |
| 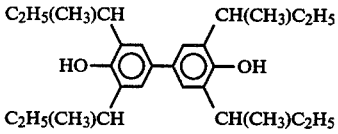 | 2,2',6,6'-tetra(1-methylpropyl)-4,4'-biphenol |
| 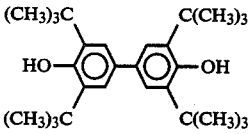 | 2,2',6,6'-tetra(tert-butyl)-4,4'-biphenol |
| 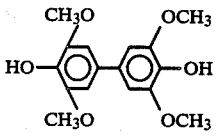 | 2,2',6,6'-tetra(methoxy)-4,4'-biphenol |
| 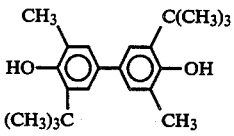 | 2,2'-dimethyl-6,6'-di(tert-butyl)-4,4'-biphenol |

The reducing agent for silver ion used in at least one color-forming layer of the present invention is a biphenol derivative which will reduce silver ion to metallic silver in the presence of at least one of a specific class of carboxylic acids which preferably is an aromatic acid and produce a colored quinone. Preferably R of formula I above is methyl or tert-butyl, and $R^1$ is hydrogen. Most preferably the biphenol reducing agent is 2,2',6,6'-tetramethyl-4,4'-biphenol or 2,2'-dimethyl-6,6'-di(tert-butyl)-4,4'-biphenol.

The reducing agent should be present as 0.5 to 5 percent by weight of the coating solution (silver or topcoat layer). In a two-layer construction, if the reducing agent is in the second layer, slightly higher proportions, of from about 0.5 to 10 percent, tend to be more desirable. Conventional photographic developers such as phenidone, hydroquinones, and catechol are useful in minor amounts, and hindered phenol reducing agents may also be added.

P-biphenols can be prepared from oxidative coupling of phenols according to U.S. Pat. No. 4,097,461.

Surprisingly, as noted above, certain carboxylic acids, preferably an amino-substituted aromatic acid, and most preferably p-aminobenzoic acid, available from Aldrich Chem. Co., optionally in the presence of a toner, can be used as a developer modifier. Other acids useful as development modifiers include phthalic acid, 3- or 4-nitrophthalic acid, benzoic acid, maleic acid, dichloromaleic acid, succinic acid, suberic acid, cinnamic acid, nitrocinnamic acid, 3- or 4-methylphthalic acid, 4-aminosalicylic acid, 3,5-diaminobenzoic acid, and 2,3-naphthalenedicarboxylic acid. P-aminobenzoic acid may be useful in combination with at least one of additional carboxylic acid development modifiers such as 1,2,4-benzenetricarboxylic acid, 2,3-naphthalenedicarboxylic acid, 4-methylphthalic acid, homophthalic acid, 3- or 4-nitrophthalic acid, o-phenylacetic acid, naphthoic acid, naphthalic acid, phthalic anhydride, naphthalic anhydride, and the like. The development modifier preferably is located in the topcoat but all or part of it may be in the silver-containing layer. Development modifiers are useful in a range of 0.01 to 2.0 (preferably 0.2 to 1.0) weight percent of the coating solution.

Any toner known in the art is useful in the present invention in an amount in the range of 5.0 to 80 mg per 100 g of silver or topcoat solution, preferably the toner is selected from phthalazine, imidazole, phthalazinone, N-aminophthalimide, and most preferably it is phthalazine. Since phthalazinone readily gives dense black or brown images it is useful in very small amounts, e.g., 5.0 to 50 mg per 100 g of solution.

The present invention provides a Δ density in the range of 0.3 to 1.8.

The photothermographic color construction may comprise two or three different monocolor-forming layers to provide a 2- or 3-color-forming system. The first color-forming layer may, for example, be coated out of a lower alkyl alcohol solvent system. The barrier layer, for example, which may be impervious to toluene or acetone and is disclosed in the above-mentioned U.S. Ser. No. 495,468, can be used as a barrier to a second (or upper) color-forming layer which is coated out of toluene or acetone. Between this two-color, three layer construction and an overlying third color alcohol solvent system, a second barrier layer is used, which barrier layer should be impervious to alcohol. For example, methylmethacrylate polymeric material as disclosed in the above-mentioned U.S. Ser. No. 475,441, is a barrier layer impervious to alcohol. Additional color-forming layers may be added above or below this 2-color system, but in each case a barrier layer is used which is impervious to the solvent of the color-forming layer above it.

The coatings can either be coated as single layers, as for example by knife-coating or extruding, and dried before the next layer is applied or each monocolor can be dual coated, as for example by dual slide-coating or dual extrusion, i.e., each of the sensitized silver layers with its respective topcoat, which may contain a barrier resin, can be cioated together to reduce the number of passes through the coater.

The silver source material, as mentioned above, may be any material which contains a reducible source of silver ions. Silver salts of organic acids, particularly long chain (10 to 30, preferably 15 to 28, carbon atoms) fatty carboxylic acids are preferred. Complexes of organic or inorganic silver salts wherein the ligand has a gross stability constant for silver ion of between 4.0 and 10.0 are also desirable. The silver source material should constitute from about 5 to 70 and preferably from 7 to 30 percent by weight of the imaging layer. The second layer in a two-layer construction would not affect the percentage of the silver source material desired in the single imaging layer.

The silver halide may be any photosensitive silver halide, preformed or formed "in situ", such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.75 to 15 percent by weight of the imaging layer, although larger amounts up to 20 or 25 percent are useful. It is preferred to use from 1 to 10 percent by weight silver halide in the imaging layer and most preferred to use from 1.5 to 7.0 percent.

The binder for the silver coating can be any known in the art but preferably it is selected from well-known natural and synthetic resins such as gelatin, polyvinyl acetals, polyvinyl chloride, polyvinyl acetate, cellulose acetate, ethyl cellulose, polyolefins, polyesters, polystyrene, polyacrylonitrile, polycarbonates, methacrylate copolymers, maleic anhydride ester copolymers, and butadiene-styrene copolymers, and the like. When simultaneous coating of layers is used, the binder is selected to coordinate with the solvent used. Copolymers and terpolymers which include the above-stated binders are of course included in these definitions. The preferred photothermographic silver-containing binder is polyvinyl butyral. The binders are generally used in a range of from 20 to 75 percent by weight of each layer, and preferably about 30 to 55 percent by weight.

Additives known in the art for providing print stability, development modification, and shelf life stability may be added to any layer of the construction. "Antifoggants", e.g., tetrachlorophthalic acid, tetrachlorophthalic anhydride, benzotriaozole and derivatives thereof, and phenyl mercaptotetrazole or tautomers or derivatives thereof may be present in the range of 5 to 100 mg of antifoggant per 100 g of either the silver or topcoat solution.

Objects and advantages of this invention are further illustrated by the following examples, but the particular materials and amounts thereof recited in these examples, as well as other conditions and details, should not be construed to unduly limit this invention.

SILVER SOAP DISPERSION PREPARATION

A silver benehate half soap was homogenized in a 90 weight percent ethanol/10 weight percent toluene solvent system at 11 weight percent solids. Then 389.8 grams of this were diluted with 113 cc of ethanol and 34.7 grams of polyvinyl butyral (Butvar -B 76) were added with mixing until it dissolved. This was designated silver soap dispersion (A).

EXAMPLE 1

The silver soap dispersion (A) (30 g) described above was diluted with 6 cc of ethanol. Then this dispersion was halidized with 0.4 cc of a solution having 5.72 g calcium chloride per 100 cc ethanol. The following reactants were then added:

3 cc of 5 p-aminobenzoic acid/100 cc methanol, and
3 cc of 10 g 2,2'dimethyl-6,6'-di(tert-butyl)-4,4'-biphenol/100 cc methanol.

The solution was coated onto 50.8 micrometer thick (2 mil) $TiO_2$-filled polyester at a thickness of 102 micrometers (4 mils) and dried. This coated material was exposed for 2 minutes of UV light from a "VIOLITE" light exposure unit (black fluorescent) through a black and white negative. The exposed article was then processed for 20 seconds at 127° C. (260° F.) on a 3M Model 70 heat blanket. A yellow image formed with a density of 0.75 and a background density of 0.34 as measured by a Macbeth Reflectance Densitometer using a blue filter.

EXAMPLE 2

Materials and procedure were utilized as in EXAMPLE 1 except that 0.2 cc of a solution having 0.57 g mercuric bromide/100 cc ethanol was added during silver halidization. The processing was identical to EXAMPLE 1 except that the coated material was heat developed for 30 seconds at 127° C. (260° F.). A yellow color image was formed with a density of 1.08 and a background density of 0.25.

EXAMPLE 3

EXAMPLE 2 was repeated except that 0.2 cc of a solution having 5 g phthalazine per 100 cc methanol was added to the formulation or to the solution mixture. A 20 second development was required. An olive color image was formed with a density of 1.02 and background density 0.24.

This EXAMPLE shows that use of phthalazine in the formulation increased the development rate and gave an olive color.

EXAMPLE 4

EXAMPLE 1 was repeated except that biphenol was used as the developer. The processing was identical to that of EXAMPLE 1 except that only a 4 second development at 127° C. (260° F.) was required. A dark brown image was formed with a density of 1.21 and a background of 0.15.

This EXAMPLE shows that a darker color image is formed using unsubstituted biphenol when compared to substituted biphenols.

EXAMPLE 5

A two-color recording system was prepared by coating four layers in the following manner.

The first layer contained 0.0042 g of 454*, a blue spectral sensitizing dye, dissolved in 6 ml of methanol which was then added to 100 g of silver dispersion (B).

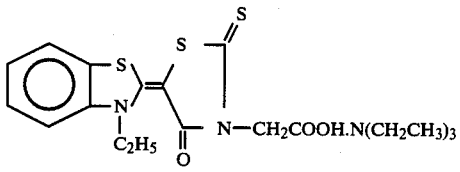

Silver Dispersion (B)

| Charge | Material | Amount | Mixing time (Min.) |
|---|---|---|---|
| A | silver dispersion | 127 g | |
| B | toluene | 160 g | 10 |
| C | 10% polyvinyl butyral resin, m.w. 180,000–270,000 Butvar ® B-72 (Monsanto Corp.)/methanol | 1 cc | 5 |
| D | 4 g Hg acetate/100 cc methanol | 3 cc | 10 |
| E | 0.36 g $HgBr_2$/100 cc methanol | 3 cc | 5 |
| F | 4 g $CaBr_2$/100 cc methanol | 3 cc | 45 |
| G | 10% Butvar ® B-72/methanol | 1 cc | 15 |
| H | 0.36 g $HgBr_2$/100 cc methanol | 3 cc | 5 |
| I | 4 g $CaBr_2$/100 cc methanol | 3 cc | 120 |
| J | Butvar ® B-72 | 28 g | 30 |
| K | 10% Butvar ® B-72/methanol | 343 g | 55 |

0.0146 g of 454 blue spectral sensitizing dye (see formula above) was dissolved in 6.43 g of methanol and the resulting solution was then added 30 minutes later with mixing.

The dispersion was coated at a 0.76 mm (3 mil) orifice and dried.

The second layer was coated at a 0.10 mm (4 mil) orifice and acted as the barrier to the upper next two layers. This layer consisted of 0.3 g 2,2',6,6'-tetramethylbiphenol
0.04 g phthalic acid
0.08 g 4-methyl phthalic acid
0.10 g phthalazine
9.35 g methanol which were dissolved and added in sequence to the following resin mixture:

80.0 g methanol
12.5 g 50 percent Gantrez-ES 225/ethanol premixed for 30 minutes with 0.28 g 2-amino-2-methylpropanol
7.5 g polyvinylpyrrolidone After this coating was dried, the third layer, a silver dispersion similar to silver dispersion B except that charge K was changed to 10 weight percent Butvar-B 76 in 90 weight percent toluene-10 weight percent ethanol and 0.0073 g of a green spectral-sensitizing dye, Erythrosin** (Eastman Kodak, Rochester, NY), which was dissolved in 6.43 g of methanol, was used in place of 454. The dispersion was applied at a 0.076 mm (3 mil) orifice.

**Erythrosin

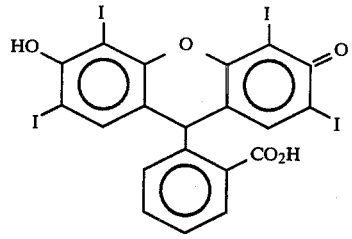

The fourth layer, applied after the third layer was dried, was applied at a 0.076 mm (3 mil) orifice and consisted of the following:

Part 1

0.26 g indoaniline leuco dye

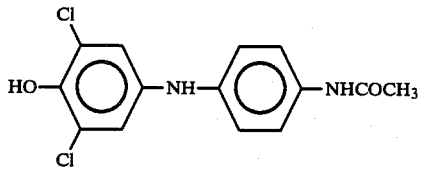

Part 2

6.31 g ethanol
0.30 g phthalic acid
13.0 g toluene
3.95 g ethanol

Parts 1 and 2 were predissolved and mixed. This was added to 25 g of the following resin premix:

15 g Acryloid TM -A21 (30 percent solids in 90 g toluene/10 g butanol) (methyl methacrylate polymer, Union Carbide)
15 g Acryloid TM -B 44 (30 weight percent solids in 70 g toluene) (methyl methacrylate copolymer, Union Carbide) 70 g toluene After the fourth layer was dried, a print was made of a continuous wedge by exposure for $10^{-3}$ seconds xenon light source of an EGG Mark VII sensitometer using narrow band filters of peak transmission of 450 and 540 nm to give a yellow-colored image at 450 nm and a magenta image at 540 nm, the samples were processed for 20 seconds at 124° C. The resulting colored wedges were run on a computer densitometer using a blue filter for the yellow image and a green filter for the magenta image. Sensitivity data is shown in TABLE I.

TABLE I

| Filter response | Wratten TM Green (Eastman Kodak) | Wratten TM 47B Blue |
|---|---|---|
| Dmin | 0.17 | 0.23 |
| Dmax | 1.70 | 1.89 |
| gamma angle | 53 | 61 |
| ergs/cm$^2$ at 1.0 density above fog | 46 | 17 |
| image color | magenta | yellow |

The data of TABLE I show good color separation between the magenta and yellow layers was achieved, illustrating the usefulness of the present invention in a multilayered system using a barrier layer.

EXAMPLE 6

Preparation of Silver Dispersion (D)

A silver dispersion was prepared by homogenizing 12.7 g of a silver half soap of behenic acid (any other $C_{16}$ to $C_{24}$ fatty acid can be used) in 102.9 g toluene and 11.4 g ethanol using two passes at 4000 and 8000 psi using a "Gaulin"(Manton-Gaulin 15M 8TBA SMD model) homogenizer. This mixture was diluted with 157 g toluene and 18 g acetone and then mixed for 20 minutes. Then 0.10 g polyvinylbutyral polymer was added and mixed until dissolved. A 3 ml portion of a 3.6 g mercuric bromide in 100 ml methanol solution was added and mixed for 10 minutes. This addition was repeated three more times with the addition of 0.10 g polyvinylbutyral polymer between the second and third halide addition. The final addition was 400 g of a 10 weight percent polyvinylbutyral polymer dissolved in a 90 toluene, 10 acetone solvent (parts by weight) mixture. A 1.1 ml solution of 0.18 g 454 dye in 100 ml of methanol was added to 100 g of the finished silver solution. This solution was coated at a 3 mil orifice on a laboratory hand coater onto a 76 micrometer thick (3 mil) opaque polyester backing. The resulting coating was dried at 82° C. (180° F.).

EXAMPLE 7

A protective topcoat solution was prepared using the following formulation and incorporating therein a selected acid development modifier:

Part A (Premix A)

75 g 10 weight percent polyvinylpyrrolidone (PVP-K90) in methanol 25 g 25 weight percent Gantrez -ES 225 dissolved in a 50 ethanol/50 methanol solvent (parts by weight) mixture which had been neutralized with 0.022 g of 2-amino-2-methyl-1-propanol per 1 g of 50 weight percent Gantrez -ES 225 in ethanol The components were mixed together for 30 minutes at room temperature or until all components dissolved.

Part B 12 ml methanol
0.3 g 2,2'-dimethyl-6,6'-di(tert-butyl)4,4'-biphenol
0.06 g acid development modifier (See Table I below)
0.10 g phthalazine
40.0 g Part A Premix The following acids were individually added to the above topcoat formulation and tested separately by coating these solutions at a 0.10 mm (4 mil) orifice onto the support of EXAMPLE 1. The resulting coating was dried at 82° C. (180° F.). It was then exposed through a continuous or step wedge to an unfiltered xenon flash for $10^{-3}$ seconds and processed at 124° C. (255° F.) for 20 seconds on a heated convex surface. Density and sensitivity data is shown in TABLE II.

TABLE II

| Sample | Acid development modifier | Dmin | Dmax | Gamma angle | Sensitivity/fog ergs/cm$^2$ at 0.4 density |
|---|---|---|---|---|---|
| 1 | phthalic | 0.22 | 1.68 | 68 | 57 |
| 2 | benzoic | 0.13 | 0.93 | 27 | 2,038 |
| 3 | itaconic | 0.12 | 1.16 | 27 | 1,994 |
| 4 | maleic | 0.14 | 0.66 | 24 | 2,594 |

As the data of TABLE II show, all examples gave useful images although sample 3 containing phthalic acid gave the greatest image density and sensitivity.

EXAMPLE 8

A silver half soap of behenic acid (1.8 kg, 4.0 lbs.) were homogenized in 10.3 kg (22.7 lbs.) of acetone using two passes at 4000 and 8000 psi. This dispersion was diluted with 67.5 kg (148.5 lbs.) of toluene, then 13.0 g of polyvinylbutyral was added with mixing until dissolved. The following additions were then made:

| | |
|---|---|
| A. mercuric acetate | 15.6 g |
| A. methanol | 390 cc |
| E. mercuric bromide | 1.404 g |
| E. methanol | 390 cc |
| F. calcium bromide | 15.6 g |
| F. methanol | 390 cc |
| G. polyvinylbutyral | 13 g |
| H. repeat E, E | |
| I. repeat F, F | |
| J. polyvinylbutyral | 17.84 pounds |
| K. Lith 454 dye | 1.96 g |
| K. methanol | 1090 cc |

The resulting mixture was coated onto a 50.8 micrometer thick (2 mil) $TiO_2$ filled polyester base at 6.45 g/m$^2$ using a laboratory 30.5 cm (12 inch) coater.

EXAMPLE 9

A protective topcoat was prepared using 50 g of Part A Premix A of EXAMPLE 7 and diluting it with 50 g of methanol. Then 2.0 g of 2,2'-dimethyl-6,6'-di(tert-butyl)-4,4'-biphenol and 0.04 g of phthalazine were added. This was designated Premix B. The acids to be tested (see TABLE II below) were then added to Premix B at a concentration of 0.10 g to 0.20 g per 25 grams of premix. These solutions were then coated onto the silver coating described in EXAMPLE 8 at a 0.076 mm (3 mil) orifice and dried at 82° C. (180° F.). The coated samples were then exposed to an unfiltered xenon flash for $10^{-3}$ seconds through a continuous step wedge and then heat processed for 80 seconds at 124° C. (255° F.) on a convex heated surface. Density and sensitivity data is shown in TABLE III.

TABLE III

| Sample | Acid development modifier | Dmin | Dmax | Gamma angle | Sensitivity over fog at ergs/cm$^2$ at 0.4 density |
|---|---|---|---|---|---|
| 5 | 0.10 g p-aminobenzoic | 0.34 | 2.07 | 59 | 348 |
| 6 | 0.20 g p-aminobenzoic | 0.62 | 1.73 | 56 | 238 |
| 7 | 0.10 g 4-aminosalicylic | 0.43 | 2.05 | 61 | 736 |
| 8 | 0.10 g 3,5-diaminobenzoic | 0.35 | 0.79 | 15 | 82,544 |

The data of TABLE III show that images were formed in all of samples 5 to 8 with samples 5 and 6, containing p-aminobenzoic acid, giving superior results.

EXAMPLE 10

A topcoat premix, designated Premix C, was prepared by diluting 75.0 g of Premix A of EXAMPLE 7 with 75.0 g of methanol. Then 1.128 g of 2,2'-dimethyl-6,6'-di(tert-butyl)-4,4'-biphenol and 0.228 g of 4-methylphthalic acid were added and dissolved in this solution. The toners to be tested were added to topcoat Premix C at a concentration of 0.06 g per 25 g of Premix C. These were coated and processed as described in EXAMPLE 9. Density and sensitivity data is shown in TABLE IV.

TABLE IV

| Sample | Developer | Dmin | Dmax | Gamma angle | Sensitivity over fog at ergs/cm$^2$ for 0.4 density |
|---|---|---|---|---|---|
| 9 | 5-aminoindazole | 0.33 | 0.68 | 12 | 13,928 @ 0.2 |
| 10 | phthalimide | 0.25 | 1.43 | 42 | 2,692 |
| 11 | N—amino-phthalimide | 0.28 | 1.95 | 46 | 721 |
| 12 | 2-amino-5-chloro-benzimidazole | 0.26 | 1.06 | 24 | 12,904 |
| 13 | None (control) | 0.27 | 1.24 | 32 | 10,632 |

The data of TABLE IV show that by comparison with the control, phthalimide and N-aminophthalimide acted as toners or accelerators due to their higher image density and light sensitivity. 5-Aminoindazole and 2-amino-5-chlorobenzimidazole (samples 14 and 17) did not act as toners.

EXAMPLE 11

Various polymers were evaluated with the combination of p-aminobenzoic acid, phthalazine, and substituted biphenol as reducing agent. The following component levels were used per 25 g of the polymer being evaluated:

0.50 g 2,2'-dimethyl-6,6α-di(tert-butyl)-4,4'-biphenol
0.01 g phthalazine
0.10 g p-aminobenzoic acid The various solutions were coated and processed as described in EXAMPLE 9. Density and sensitivity data is shown in TABLE V.

TABLE V

| Sample | Polymer Solution | Dmin | Dmax | Gamma angle | Sensitivity above fog in ergs/cm$^2$ at 0.4 density |
|---|---|---|---|---|---|
| 14 | 5% polyvinylbutyral (Butvar 76) | 0.43 | 1.87 | 53 | 399 |
| 15 | 10% Gantrez -ES 225 | 0.37 | 1.06 | 28 | 5,136 |
| 16 | 10% neutralized Gantrez -ES 225 (EXAMPLE 2, Part A) | 0.48 | 1.71 | 46 | 506 |
| 17 | 5% polyvinylpyrrolidone (PVP-K90) | 0.27 | 1.50 | 58 | 3,392 |
| 18 | 5% Gantrez -ES 225/ PVP-K90 (EXAMPLE 8) | 0.34 | 2.07 | 59 | 348 |

The data of TABLE V show that satisfactory results were achieved with all polymers tested.

EXAMPLE 12

Combination of Carboxylic Acids With Low Levels of Phthalazinone

Phthalazinone at low levels was combined with 0.8 grams of 4-methylphthalic or p-aminobenzoic acids in 100 grams of Premix A of EXAMPLE 7. The acids were predissolved with the phthalazinone in 30 ml methanol before mixing into the Premix. These solutions were then coated onto the silver coating at a 0.076 mm (3 mil) orifice and dried at 82° C. (180° F.). They were than exposed through a continuous or step wedge to an unfiltered xenon flash for $10^{-3}$ seconds and processed at 124° C. (225° F.) for 20 seconds on a heated convex surface. Levels of phthalazinone, density, and sensitivity data are shown in TABLE VI below.

TABLE VI

| Sample | Phthalazinone per 100 g Premix A (mg) | Acid, (800 mg/100 g) Premix A | Dev. Time | Dmin | Dmax | Gamma angle | Sensitivity above fog ergs/cm$^2$ at 0.4 density |
|---|---|---|---|---|---|---|---|
| 28 | 100 | none | 40 | 0.33 | 1.65 | 41 | 978 |
| 29 | 40 | 4-methylphthalic | 20 | 0.21 | 1.88 | 41 | 739 |
| 30 | 20 | 4-methylphthalic | 20 | 0.21 | 1.94 | 49 | 898 |
| 31 | 200 | p-aminobenzoic | 20 | 0.23 | 1.72 | 53 | 1629 |
| 32 | 100 | p-aminobenzoic | 40 | 0.27 | 1.72 | 52 | 983 |
| 33 | 40 | p-aminobenzoic | 40 | 0.25 | 1.65 | 50 | 1626 |

The data of TABLE VI show all samples gave an image. All images were yellow to gold in color except sample 28 was brown. The p-aminobenzoic acid gave a clear yellow color which was due to a lower silver image density.

EXAMPLE 13

Combination of p-Aminobenzoic Acid With High Levels of Phthalimide and p-Aminophthalimide Phthalimide and N-aminophthalimide were combined with p-aminbenzoic acid using Premix A of EXAMPLE 7; they were also evaluated without the acid at a higher level. These solutions were coated, dried, and processed as in EXAMPLE 12. Density and sensitivity data are shown in TABLE VII.

TABLE VII

| Sample | Toner | Amt. mg/100 g | P—amino benzoic acid | Dev. time 255° F. | Dmin | Dmax | Gamma angle | Sensitivity above fog in ergs/cm²at 0.4 density | Image color |
|---|---|---|---|---|---|---|---|---|---|
| 34 | phthalimide* | 800 | No | 20 | 0.59 | 2.02 | 56 | 165 | green |
| 35 | phthalimide | 400 | Yes | 20 | 0.25 | 1.84 | 58 | 342 | yellow |
| 36 | N—aminophthalimide* | 800 | No | 30 | 0.30 | 1.21 | 58 | 1841 | green |
| 37 | N—aminophthalimide | 400 | Yes | 20 | 0.26 | 1.73 | 49 | 1224 | yellow |

*without acid

The data of TABLE VII show that the toners by themselves gave green images, but in combination with p-aminobenzoic acid the preferred yellow color was formed.

EXAMPLE 14

Preparation of Silver Dispersion for Developer Evaluation

A light-sensitive silver soap solution was prepared as in EXAMPLE 8 with the exception that the mercuric acetate was omitted and calcium bromide was replaced by mercuric bromide. This was coated onto an ICI Melinex TM Type 329 0.076 mm thick (versicular) opaque polyester (ICI Americas Inc., Wilmington, DE) at 6.45 g/m² using a laboratory hand coater and dried at 82° C. (180° F.).

The topcoat was prepared by predissolving 0.50 to 0.75 g of a biphenol with 0.15 g phthalic acid and 0.50 g phthalazine in 30 ml of methanol, and then combining this solution with 100 g Premix A (part A) of EXAMPLE 7. These solutions were coated at a 0.10 mm (4 mil) orifice onto a precoated silver solution and then dried at 82° C. (180° F.). They were then processed as in EXAMPLE 7, except that they were exposed through a filtered xenon flash using a Wratten 47B filter (440 nanomethers). Density and sensitivity data are shown in TABLE VIII.

TABLE VIII

| Sample | Developer mg/100 g Premix A | Dmin | Dmax | Gamma Angle | Sensitivity above fog; ergs/cm² at 0.4 density |
|---|---|---|---|---|---|
| 38 | 500 mg biphenol | 0.13 | 0.52 | 12 | 56 at 0.2 |
| 39 | 750 mg 2,2',6,6'-tetra(tert-butyl)-4,4'-biphenol | 0.26 | 1.59 | 67 | 4.2 |
| | 750 mg 2,2',6,6'-tetra(diethyl)-4,4'-biphenol | 0.22 | 2.02 | 74 | 8.0 |

The data of TABLE VIII show that sample 38 had a neutral gray color, showing that unsubstituted biphenol did not form a yellow color, while samples 39 and 40, using substituted biphenols, gave a yellow-green color.

Various modifications and alterations of this invention will become aparent to those skilled in the art without departing from the scope and spirit of this invention, and it should be understood that this invention is not to be unduly limited to the illustrative embodiments set forth herein.

I claim:

1. A photographic construction comprising at least one polymeric binder layer containing spectrally-sensitized photographic silver halide and, in association therewith a. a non-light sensitive organic silver salt oxidizing agent, b. at least one biphenol color-forming reducing agent having the formula

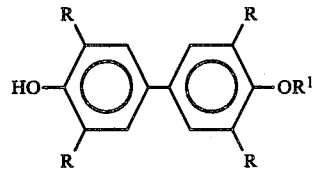

wherein each R is independently selected from a straight chain or branched alkyl or alkoxy group having 1 to 6 carbon atoms, and phenyl, and $R^1$ is hydrogen or an alkali-labile protecting group, and c. at least one aliphatic or aromatic carboxylic acid as development modifier, the acid having the formula $R(COOH)_x$ wherein x is an integer having the value 1 or 2, R is a group which is unsubstituted or substituted by at least one group selected from amino, hydroxyl, lower alkyl ($C_1$ to $C_4$), nitro, and one or two chloro atoms, wherein when x is 1, R is selected from the group consisting of alkenyl, aryl, and phenylalkyl, having up to 10 carbon atoms, and when x is 2, R is selected from the group consisting of alkenylene, alkylene, and arylene, having up to 14 carbon atoms; and d. optionally, at least one toner; said polymeric binder layer being capable of providing a yellow to gold color upon development.

2. The photographic construction according to claim 1 wherein $R^1$ is hydrogen.

3. The photographic construction according to claim 1 wherein R is selected from the group consisting of methyl and tert-butyl.

4. The photographic construction according to claim 1 wherein said biphenol is selected from the group consisting of 2,2,6,6'-tetramethylbiphenol and 2,2'-dimethyl-6,6'-di(tert-butyl)-4,4'-biphenol.

5. The photographic construction according to claim 1 wherein said development modifier is an aromatic acid.

6. The photographic construction according to claim 1 wherein said development modifier is selected from the group consisting of amino- and nitro-substituted aromatic acids.

7. The photographic construction according to claim 1 wherein said development modifier is selected from the group consisting of p-aminobenzoic acid, phthalic acid, 3- or 4-nitrophthalic acid, benzoic acid, maleic acid, dichlormaleic acid, succinic acid, suberic acid, cinnamic acid, nitrocinnamic acid, 3- or 4-methylphthalic acid, 3,5-diaminobenzoic acid, and 4-aminosalicylic acid, and 2,3-naphthalenedicarboxylic acid.

8. The photographic construction according to claim 7 wherein said development modifier is p-aminobenzoic acid.

9. The photographic construction according to claim 1 wherein said reducing agent is present in the range of 0.5 to 5 weight percent of the coating solution.

10. The photographic construction according to claim 1 wherein said construction has a Δ density in the range of 0.3 to 1.8.

11. The photographic construction according to claim 1 wherein said development modifier is present in the range of 0.01 to 2.0 weight percent of the coating solution.

12. The photographic construction according to claim 11 wherein said development modifier is present in the range of 0.2 to 1.0 weight percent of the coating solution.

13. The photographic construction according to claim 1 wherein said toner is selected from the group consisting of phthalazine, phthalazinone, imidazole, phthalimide, and N-aminophthalimide.

14. The photographic construction according to claim 12 wherein said toner is phthalazine.

15. The photographic construction according to claim 1 wherein said toner is present in the range of 5.0 to 50 mg per 100 g of coating solution.

16. The photographic construction according to claim 1 wherein the combination of said toner and development modifier are selected from the group consisting of (1) phthalazine and phthalic acid, (2) phthalazine and p-aminobenzoic acid, and (3) phthalazine, phthalic acid, and p-aminobenzoic acid.

* * * * *